US009084500B2

(12) United States Patent
Rush

(10) Patent No.: US 9,084,500 B2
(45) Date of Patent: Jul. 21, 2015

(54) APPARATUS FOR GUIDING MOTION OF A RECEPTACLE

(76) Inventor: Raphael Rush, Toronto (CA)

( * ) Notice: Subject to any disclaimer, the term of this patent is extended or adjusted under 35 U.S.C. 154(b) by 530 days.

(21) Appl. No.: 12/453,201

(22) Filed: May 1, 2009

(65) Prior Publication Data

US 2011/0062172 A1 Mar. 17, 2011

(51) Int. Cl.

| | |
|---|---|
| ***B65D 25/10*** | (2006.01) |
| ***A47G 19/02*** | (2006.01) |
| ***B65D 53/00*** | (2006.01) |
| ***B65D 81/24*** | (2006.01) |
| ***A47B 23/00*** | (2006.01) |
| ***A47B 37/00*** | (2006.01) |
| ***A47G 21/08*** | (2006.01) |

(52) U.S. Cl.

CPC ..... *A47G 21/08* (2013.01)

(58) Field of Classification Search

CPC .. A45F 2005/008; A47G 21/08; A47G 23/06; A47G 23/0625; A47G 23/0633; A47G 23/0225; A61J 9/06; A61J 2009/0669; A61J 2009/0676; A61J 2009/0638

USPC ..... 220/759, 574.1, 710.5, 737, 758; 108/43

See application file for complete search history.

(56) References Cited

U.S. PATENT DOCUMENTS

| | | | | | |
|---|---|---|---|---|---|
| 3,990,596 | A | * | 11/1976 | Hoftman | 215/11.1 |
| 4,414,692 | A | * | 11/1983 | Dzierson et al. | 2/160 |
| 5,176,274 | A | * | 1/1993 | Jenkins | 220/17.1 |
| 6,029,938 | A | * | 2/2000 | Fava | 248/311.2 |
| 6,840,415 | B1 | * | 1/2005 | Sapien, Jr. | 224/221 |
| 6,923,485 | B1 | * | 8/2005 | Bauswell | 294/3.5 |

* cited by examiner

*Primary Examiner* — Fenn Mathew
*Assistant Examiner* — Andrew T Kirsch

(57) ABSTRACT

A handle replacement kit for guiding motion of a receptacle by using an arm or forearm in place of a hand, without need for grasping a handle. The kit comprises a hollow receptacle retainer of varying dimensions and a pair of handle replacement members, each member extendable laterally outwardly from the receptacle retainer and connectable thereto. The handle replacement members rest on a user's arm or forearm. Motion of the handle replacement is directed by the user's arm or forearm.

1 Claim, 3 Drawing Sheets

APPARATUS FOR GUIDING MOTION OF A RECEPTACLE

FIELD OF THE INVENTION

The present invention relates to aids for disabled persons, who seek to avoid using their hands or fingers to grasp a receptacle. The invention discloses a handle replacement apparatus, a kit and methods for holding and controlling motion of a receptacle by using forearm-directed motion to raise and lower a receptacle such as a cup or a tapered glass for consumption of its contents.

BACKGROUND OF THE INVENTION

Guiding a receptacle filled with liquid or solids without spilling its contents can be a formidable challenge for people suffering impairment of fine motor skills, and in particular, disabilities related to impairment of grasping formation of the hand or fingers. By way of example, cups and removable cup sleeves, to which are attached handles of different shapes and sizes, some with openings at various locations, are usually manipulated by grasping of the hand, or fingers around the cup, or cup sleeve or cup handle. However, disabled persons, for whom controlled hand manipulation is difficult, find that keeping their hands steady while guiding movement of a receptacle is rendered difficult, inconvenient and/or inefficient because grasping of a receptacle handle, sleeve, or receptacle itself may not be achievable. The simple pleasures of drinking a cup of tea or coffee or a glass of milk-something of a mundane addiction, taken for granted by many people—is one example of an everyday activity which cannot be easily undertaken by persons with limited ability to we their hands to grasp a cup or handle.

An advantage of the invention is that it is structured to fit on an arm or forearm, thereby offering an alternative to finger grasping, which is replaced by forearm motion.

A second advantage of the present invention is that it allows for alternative distribution of weight and force, by relying upon an arm or forearm rather than individual fingers (smaller digits).

A third advantage of the present invention is that it provides a handle replacement element which permits insertion of a hand (comprising multiple fingers spaced adjacent one another) or a large limb such as an arm or forearm, allowing access to the handle replacement during all phases of holding and moving a receptacle such as a cup.

Another advantage of the present invention is that it enables a person without fingers, with a truncated forearm, or with a missing limb or limbs, to raise and lower a receptacle, such as a cup.

Another advantage of the present invention is to provide a frame which improves stable positioning of a receptacle in a steady centered position.

It is yet another advantage of the present invention to provide a cup holder which is capable of absorbing pressure from the weight of a cup, when filled, in a manner which reduces the tendency of the arm ox forearm to be pushed down.

It is yet another advantage of the present invention to provide an apparatus which renders it convenient for the arm or forearm to access the handle replacement element from any angle, and provides stability of the receptacle for consumption of its contents when the apparatus is in use.

The invention also provides the advantage of disclosing to persons who have impaired use of their fingers or other physical disabilities, a method of using a limb or limbs as an alternative to finger grasping, by relying upon an arm or forearm for independent feeding, to control delivery of liquids or other contents from a receptacle, to enhance their ability to feed themselves.

These and other advantages of the present invention will be apparent to those skilled in the art from the disclosure which follows.

SUMMARY OF THE INVENTION

The above and other objects of the present invention are achieved by providing an apparatus which comprises an improvement over the prior art, in which handles are disclosed, by offering an alternate to the traditional gripping mechanism. The apparatus of the invention offers a frame which defines an opening large enough to retain a receptacle of varying dimensions. The handle replacement element of the apparatus is connected to the frame and dimensioned to rest securely on an arm or forearm and be engageable therewith.

According to one aspect of the present invention, there is provided an apparatus having a retainer frame and at least one handle replacement element connected to and extendable laterally from the frame. The handle and frame may be integrally formed or detachably connected by connector mean. In an alternative embodiment of the invention, there is provided an apparatus having a retainer frame, and two handle replacement elements, extendable laterally from opposite sides of the retainer frame, and at least one connector, for detachably connecting each of the handle replacement elements to the frame. Each handle replacement element has a proximal end attachable to the frame and a distal free end, the interval between the proximal and distal end of the handle-replacement element dimensioned for insertion of and resting engagement upon an arm or forearm of a user. The handle replacement element may be arcuate. The frame may define an orifice large enough for passage therethrough of a receptacle of varying dimensions.

Thus, there is provided a handle replacement apparatus comprising a receptacle retainer frame, at least one handle replacement element having a proximal end, a distal end and an intermediate portion, the proximal end extending from the receptacle retainer when connected thereto, the intermediate portion of the handle replacement element configured to engage an arm or forearm, means for attaching the handle replacement element to the frame whereby in use, the retainer and handle replacement element connected by the connector means, and movement of the apparatus is operable by arm or forearm motion.

According to another aspect of the present invention there is provided a kit having a retainer frame, at least one handle replacement element extendable laterally from the frame, and a connector for attaching each handle replacement element to the frame, the connector being integral to or detachable from the frame. The handle replacement element has a proximal end attachable to the frame and a distal free end, the interval between the proximal and distal end of the handle replacement element dimensioned for insertion of and resting engagement on an arm or forearm of a user. The handle replacement element may be arcuate. The frame may define an orifice large enough for passage of a receptacle of varying dimensions. Where the frame has a seat, the seat may define an opening which is adapted for passage of a frame therethrough.

According to yet another aspect of the present invention, there is provided a method of delivering contents from a receptacle located in a handle replacement apparatus, the said apparatus comprising a frame, at least one handle replacement element extendable laterally from the retainer frame, means for attaching the handle replacement element to the frame (whether integrally or detachably). The handle replacement element has a proximal end attachable to the frame and a distal free end, the interval between the proximal and distal end of the handle replacement elements dimensioned for engagement with an arm or forearm of a user. The handle replacement element may be arcuate. The frame may define an orifice large enough for passage therethrough of the receptacle of varying dimensions, the said method comprising the steps of: securably fastening the handle replacement element on a user's arm or forearm, and moving the said arm or forearm along a predetermined path of travel, for controlling delivery of contents from the receptacle without the need to manually grasp a handle or the receptacle itself.

BRIEF DESCRIPTION OF THE DRAWINGS

These and other aspects and features of the present invention and the attendant advantages will be readily apparent to those ordinarily skilled in the art and the present invention will be more easily understood from the following detailed description of the preferred embodiment taken in conjunction with the accompanying drawings wherein like reference numbers represent like parts throughout the drawings.

DETAILED DESCRIPTION OF THE PREFERRED EMBODIMENT

While the present invention will be described fully hereinafter with reference to the accompanying drawings, in which a particular embodiment is shown, it is understood at the outset that persons skilled in the art may modify the invention herein while still achieving the same result of this invention. Accordingly, the description that follows is to be understood as a broad informative disclosure directed to persons skilled in the appropriate arts and not as limitations of the present invention as claimed.

In the following detailed description, where reference is made to a cup, it should be noted that a cup is just an example of one of the many types of receptacles which may be used with the invention.

Referring now to FIGS. 1 through 5, the holder apparatus may be cut out of a rigid material such as ⅛ aluminum or polyethylene using a Computer Numerical Control (CNC) water jet according to Computer-Aided Design (CAD) drawings. The two-dimensional cutout may have the handle replacement elements bent to the desired arc by hand in the case of a flexible material or with the aid of a heat gun or oven and mold in the case of materials which yield to formation under specific conditions such as high temperatures as in the case of polyethylene or other plastics.

Figure 1:
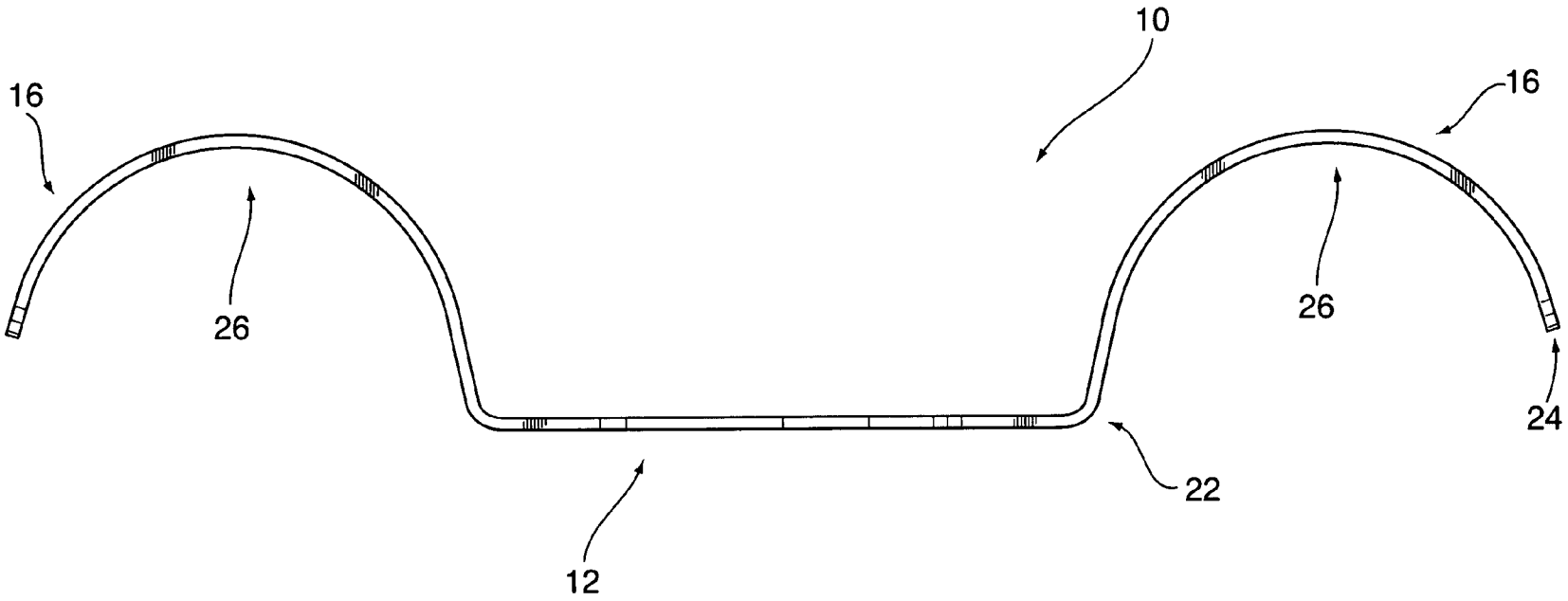
FIG. 1 is a side view of the apparatus (short arms, allowing for support with the wrists and hands) according to a preferred embodiment of the present invention having a handle replacement element on each side of the retainer frame.
Figure 2:
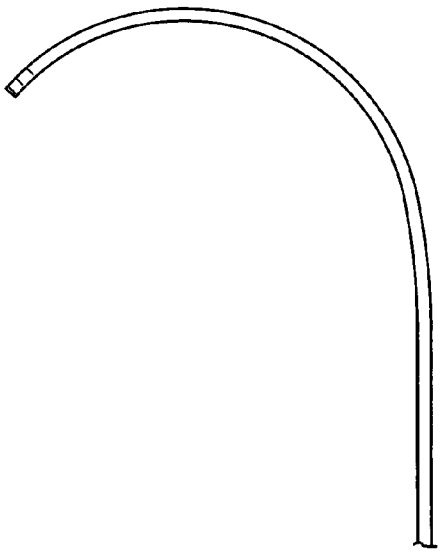
FIG. 2 is a side view of the handle replacement element.
Figure 3:
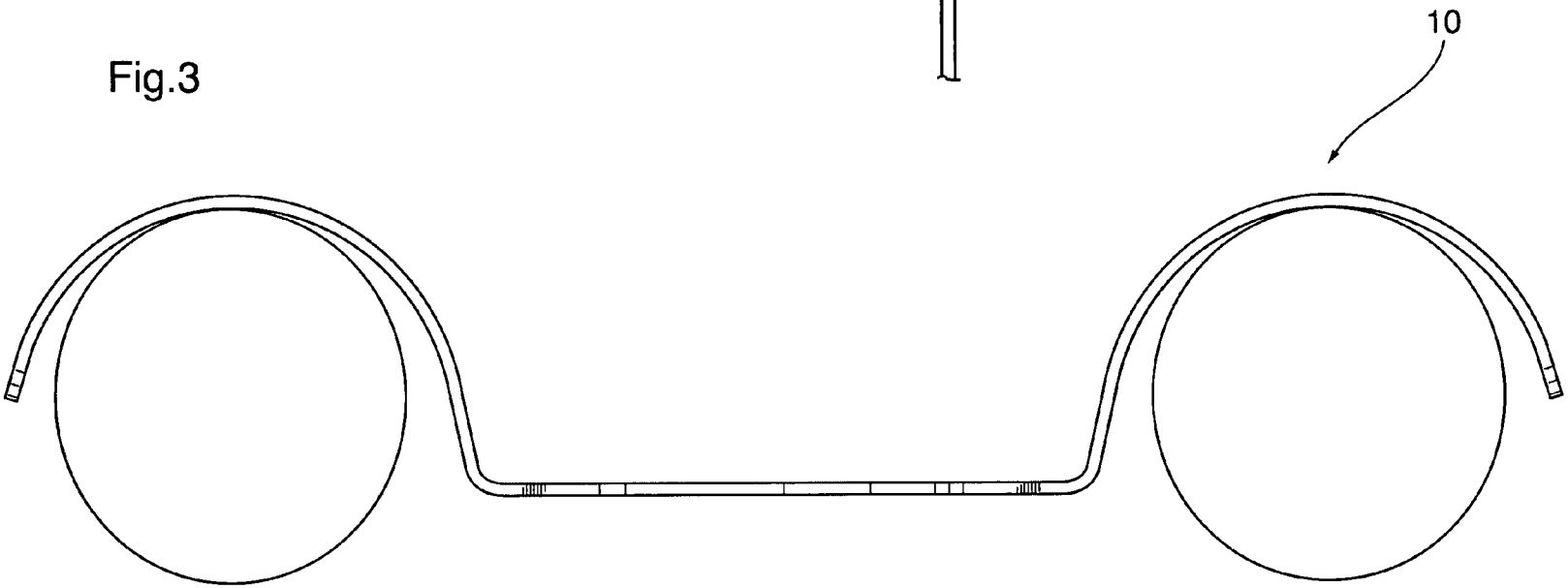
FIG. 3 is a perspective view of an embodiment of the invention having a pair of handle replacement elements, to indicate the orientation of the arm or forearm (not shown) underneath the lower surface of the handle replacement element.

Referring to FIGS. 1 through 5, a handle replacement apparatus 10 in accordance with one embodiment, a pair of handle replacement elements 16 is disclosed. The handle replacement apparatus 10 has a frame 12, as shown in FIG. 1. The base 18 of the frame 12 defines a circular orifice 20 through which a cup 14 of variable dimensions can be positioned. Referring to FIG. 2, a handle replacement element 16 is integral to or can be removably connected to the frame at proximal end 22 of handle replacement element 16. As shown in FIG. 3, the handle replacement element 16 extends outwardly in a wing-like fashion, and may be arcuate to facilitate engagement, for support, on a user's arm (not shown). When a cup 14 is placed into the cup retainer section 18 of flame 12 of the apparatus, the cup 14 can be transported by orienting the arm (not shown) on which the handle replacement element 16 is placed, instead of by being carried by grasping a cup handle or the cup body.

Figure 5:
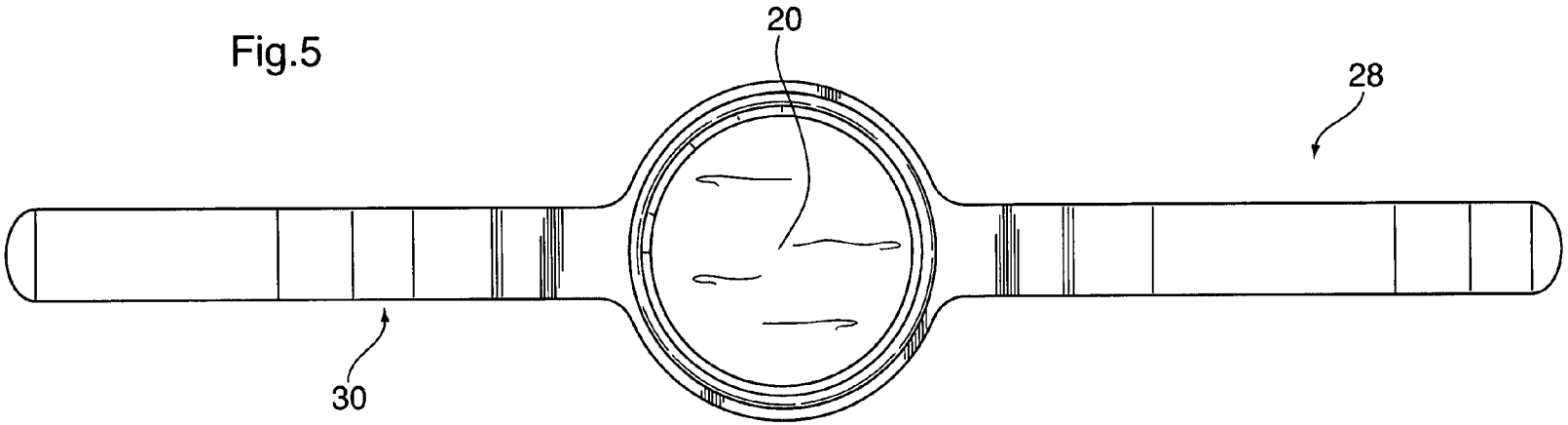
FIG. 5 is a top-view of the apparatus supporting a receptacle.

As shown in FIG. 3, the frame 12 of the apparatus includes a cup retainer section 18 and an opening 20 dimensioned for passage of a cup, as shown in FIG. 5.

Each handle replacement element 16, can either be formed integrally on the receptacle frame, or can be connected to it detachably by a connector such as VELCRO brand hook and loop tape (not shown).

Figure 4:
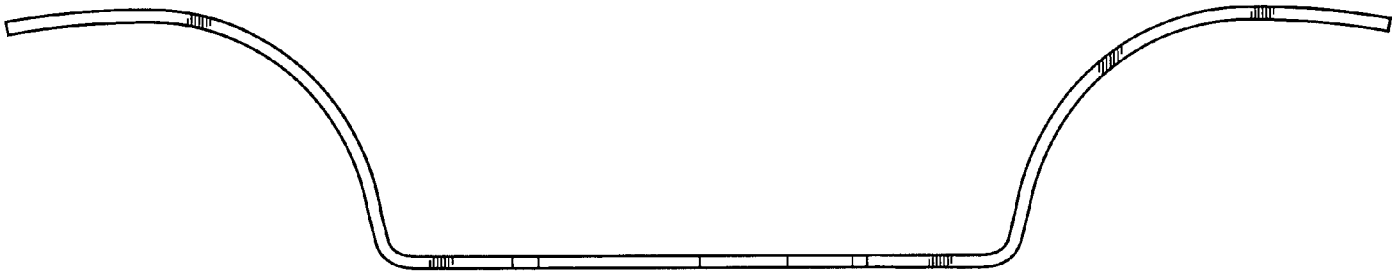
FIG. 4 is a side view of the apparatus having a pair of handle replacement elements with a larger arc (long arms, allowing for support with the forearms) according to a preferred embodiment of the present invention.

As shown in FIGS. 4, 4*a* and 4*b*, handle replacement element 16 has a first proximal end 22, a second distal end 24, and an intermediate arm rest section 26. A user can raise the handle replacement rest section, by inserting and raising his/her arm/forearm, on which the intermediate arm rest section 26 sits. The support section 16 is arucate. The handle replacement 16 may be connected detachably at each proximal end 22 such as by VELCRO brand book and loop tape, as well known in the art, or formed integrally to the frame of the apparatus.

As shown in FIGS. 4, 4*a* and 4*b*, the support section 26 has an upper 28 surface and a lower 30 surface. It is preferably configured so that the user's arm or forearm (not shown) can approach the lower 30 surface of the support section of the handle replacement element, from below at varying angles. The support section 26 is preferably arcuately shaped and dimensioned so as to accomplish this result. The support section 26 should be sufficiently sized to permit the user's arm or forearm (not shown) to rest and engage the lower surface 30 of the handle replacement element. The proximal end 22 of the support section terminates in the connection between the handle replacement element and cup retainer sections, respectively, of the frame and is a generally planar surface. FIG. 4(*a*) shows the invention supported on the right hand and FIG. (b) shows the invention as would be supported on the left hand of a user, when the invention has only one handle replacement element rather than a pair.

As shown in FIG. 5, when in use, each handle replacement member 16 extends like an arm radially outwardly from the body of the frame. The handle replacement section may be curved to fit comfortably onto a person's arm or forearm, so that the arm or forearm supports the handle replacement element thereupon. The user raises his or her forearm and brings the receptacle (not shown) to his/her mouth. A straw may be positioned within the receptacle to facilitate drinking.

The apparatus can be formed of any number of materials or combinations thereof, such as aluminum or polyethylene. One particularly preferred method of making apparatus 10 is by using a CNC OMAX water jet programmed from CAD drawings. The handle replacement element can be bent to the desired are by hand in the case of a flexible material or with the aid of a heat gun or oven and mold in the case of materials which yield to formation at high temperatures as in the case of polyethylene. The apparatus can be sold as a kit in a compact case for ease of transport and assembled at the time of use by connecting the replacement handles together to the frame, for example by means of a hook and loop tape.

What is claimed is:

1. A handle replacement kit for controlling positioning and movement of a receptacle, comprising:

a rigid receptacle retainer frame, a pair of handle replacement members, each handle replacement member having a proximal end, a distal end and an intermediate section configured for resting engagement on a user's arm or forearm, the proximal end of each handle replacement member connectable to the receptacle retainer frame, each handle replacement member extending radially outwardly and away from the body of the frame, the distal end of each handle replacement member curved to fit onto an arm of a person and a connector integrated with the frame connecting the proximal end of the handle replacement member to the receptacle retainer frame, whereby movement of the receptacle is operable by armor forearm motion when the handle replacement members connected to the receptacle retainer frame by the connector, while maintaining the receptacle retainer at a distance from the arm or forearm.

* * * * *